United States Patent [19]

Ehrichs

[11] 4,032,103

[45] June 28, 1977

[54] ADJUSTABLE STAND

[75] Inventor: Warren A. Ehrichs, Moorhead, Minn.

[73] Assignee: Ehrichs Manufacturing Company, Fargo, N. Dak.

[22] Filed: Mar. 17, 1976

[21] Appl. No.: 667,713

[52] U.S. Cl. ..... 248/421; 248/423

[51] Int. Cl.[2] ..... F16M 13/00

[58] Field of Search ..... 108/116–120, 108/145; 248/421, 423, 439, 164, 166, 434, 168, 169, 432; 297/445

[56] References Cited

UNITED STATES PATENTS

| | | | |
|---|---|---|---|
| 848,465 | 3/1907 | Homeyer | 248/423 X |
| 1,214,086 | 1/1917 | Shaw | 248/166 X |
| 2,170,098 | 8/1939 | Stephenson | 108/145 X |
| 2,805,905 | 9/1957 | Levitan et al. | 108/145 |
| 2,829,928 | 4/1958 | Callaway | 248/421 X |
| 2,843,391 | 7/1958 | Pelletier | 248/423 X |
| 3,022,037 | 2/1962 | Stallard | 248/421 |
| 3,094,948 | 6/1963 | Clow | 108/119 X |
| 3,741,512 | 6/1973 | Olsson | 248/421 |

FOREIGN PATENTS OR APPLICATIONS

| | | | |
|---|---|---|---|
| 1,107,915 | 5/1961 | Germany | 248/421 |
| 1,033,870 | 7/1958 | Germany | 108/145 |

*Primary Examiner*—Lawrence J. Staab
*Attorney, Agent, or Firm*—Frederick E. Lange

[57] ABSTRACT

An adjustable stand for supporting heavy loads such as pallets at various heights, the stand having a platform formed of four channel shaped beam members securely fastened together in a generally rectangular form with two of the beam members being relatively long and extending longitudinally of the platform and having spaced notches on their under surfaces, there being two pairs of legs disposed adjacent opposite sides of the platform, the legs of each pair being pivotally secured together near their longitudinal midpoints. The upper ends of one leg of each pair are disposed within the longitudinally extending beams and pivotally secured thereto. The upper ends of the other legs are joined together by a rod member designed to fit within the pairs of spaced notches so that the height of the platform is dependent upon the location of the pair of notches in which the rod member is placed. Resilient means are provided for biasing the legs toward the position in which the platform is at its maximum height so as to tend to counterbalance the weight of the platform and the legs and make it easier to vertically adjust the stand. The bottoms of the legs are associated with two base members which provide for stability for the stand.

6 Claims, 6 Drawing Figures

ADJUSTABLE STAND

BACKGROUND OF THE INVENTION

It is very old to have stands whose height can be adjusted. A typical stand of this type is an ironing board stand. There are, however, numerous other stands for adjustably supporting a relatively light load at any of selected heights.

While such prior art devices are in many cases well suited to the purposes for which they were designed, they would be completely useless for supporting very heavy loads such as are often encountered in a factory or machine shop. Often, the load which is to be supported is a pallet which, in turn, is loaded with heavy materials such as machine parts. To provide a stand which will support such heavy loads requires the use of very strong structural elements such as beams. When this is done, the movable elements of the stand become so heavy that it becomes extremely difficult for the user to adjust the height of the stand. When the stand is folded, it becomes extremely difficult for the user to lift the stand to its extended position.

SUMMARY OF THE INVENTION

The present invention is concerned with an adjustable stand for supporting heavy loads at various heights in which resilient means are provided for at least partially counterbalancing the weight of the movable element so as to facilitate the adjustment of the vertical height of the stand.

The stand may consist of a platform of relatively heavy construction and two pairs of legs, one leg of each pair of which is connected together at their upper ends with a rod which can fit into any one of a number of pairs of notches on the under side of the platform.

A further rod may extend between the pair of pivot points of the two pairs of legs and the biasing means may be associated with this further rod, urging the legs to a position in which the platform is at its maximum height. The platform is preferably formed of beam members which may be channel shaped members. Two of these members are relatively long and act as longitudinal members. The upper ends of two legs may extend into these channels and be pivoted thereto.

Two other channel members of the platform act as transverse members, one being secured near the end of the platform and the other at an intermediate point, so as not to interfere with adjustment of the rod carried by the legs with respect to the various notches in which it is to be placed.

The intermediate transverse channel member preferably has the side closest to the rod made of lesser width so as to minimize the possibility of the hand of the operator grasping the intermediate transverse member being accidentally engaged by the rod during the adjustment process.

In order to increase the stability of the stand, the stand may be provided with two longitudinal base members with which the legs are associated. One set of legs may be pivotally connected to the base members and the other set of legs may be associated in sliding engagement therewith. Where the base members are channel shaped, the bottoms of the legs in sliding engagement with the base members are mounted in sliding engagement within the channels of the base members.

Various other objects and features of the invention will be apparent from a consideration of the accompanying specification, claims and drawing.

DESCRIPTION OF THE PREFERRED EMBODIMENT

Figure 1:
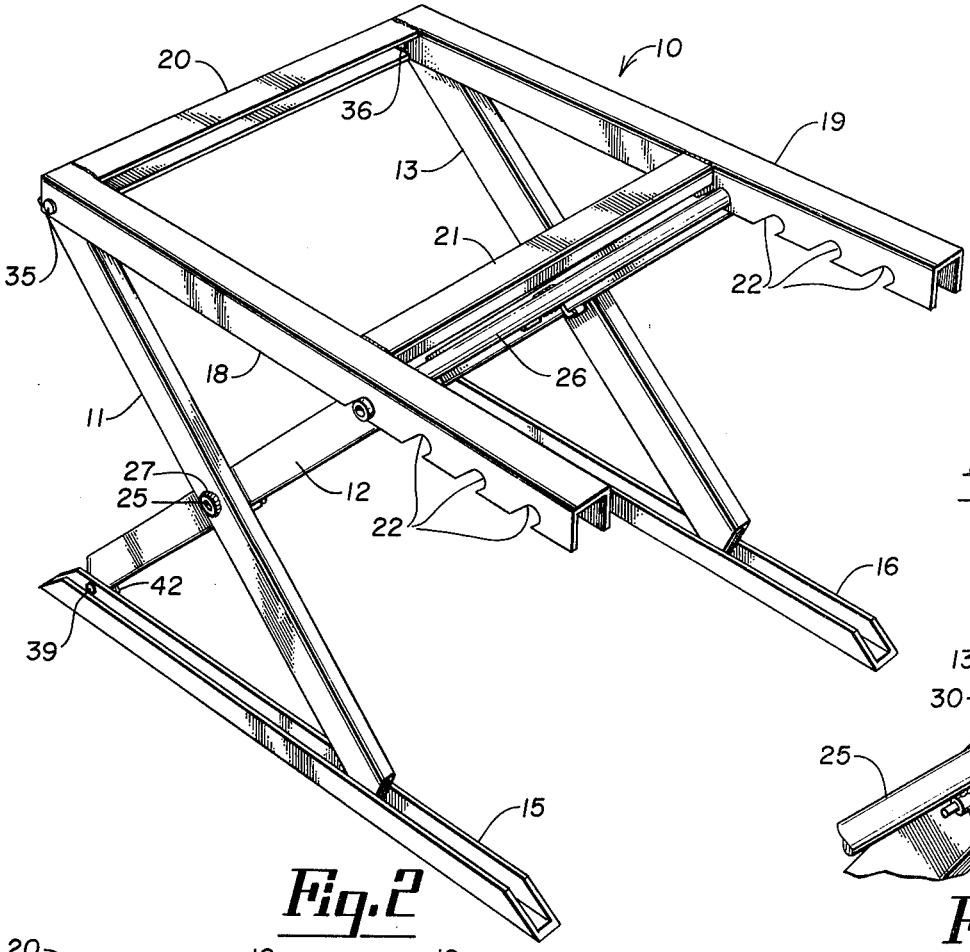
FIG. 1 is a perspective view of the improved adjustable stand.

Referring first to FIG. 1, it will be noted that there is a platform 10 consisting of four beam members 18, 19, 20 and 21 which are welded together to form a rigid platform. Supporting this platform are four legs 11, 12, 13 and 14. Leg 14 is visible only in FIGS. 2, 3 and 4. Legs 11 and 12 constitute one pair of legs and legs 13 and 14 a second pair of legs. These four legs in turn cooperate with two base members 15 and 16, the legs 11 and 12 cooperating with base member 15 and legs 13 and 14 with base member 16. As will be described in more detail later, legs 12 and 14 are pivotally secured respectively to base members 15 and 16 whereas legs 11 and 13 are slidably mounted in the base members 15 and 16, respectively.

Referring back to the platform 10, the beam members 18 and 19 constitute the longitudinal beam member of the platform and the beam members 20 and 21 the transverse beam members. It will be noted that transverse beam member 20 is connected to beam members 18 and 19 adjacent the left hand (as viewed in FIGS. 1 and 2) ends of beam members 18 and 19. Beam member 21 is, however, secured to longitudinal beam members 18 and 19 at intermediate points of these beam members so that portions of the beam members 18 and 19 project beyond the transverse beam member 21. Disposed on the under side of these projecting portions of beam members 18 and 19 are a series of inclined notches 22.

The legs of each pair of legs are pivotally secured together adjacent their midpoints by a rod 25 which may be of tubular material. Rod member 25 is preferably secured against turning with respect to the outer legs 11 and 13 by welding or any other suitable manner. In the drawing, a weld line is indicated by the numeral 27. The other two legs 12 and 14 are freely pivotal upon rod 25.

Figure 2:
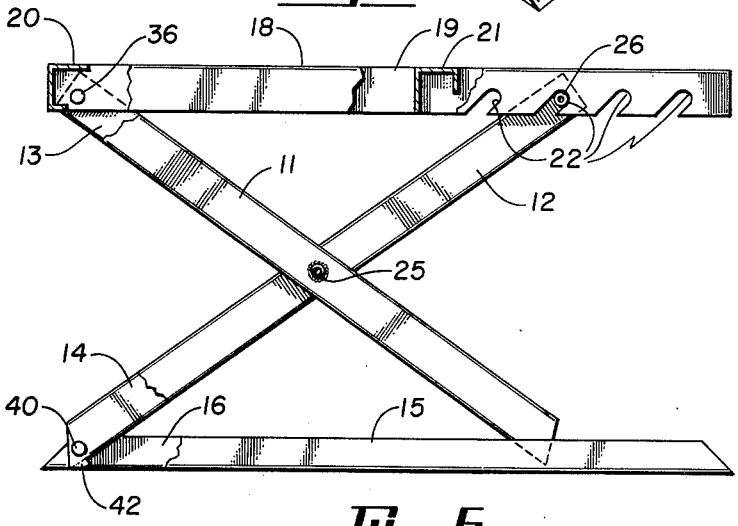
FIG. 2 is a front elevational view of the adjustable stand with portions broken away for purposes of illustration.
Figure 3:
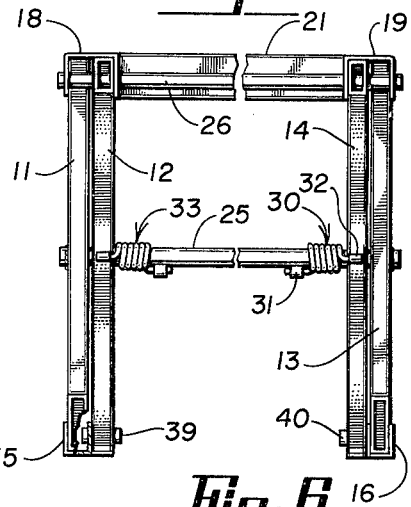
FIG. 3 is an end elevational view.

A second tubular rod 26 extends through the upper ends of legs 12 and 14 projecting outwardly beyond the legs 12 and 14, as best shown in FIG. 3. The rod 26 extends sufficiently beyond legs 12 and 14 so as to extend slightly beyond legs 11 and 13. Rod 26 is rigidly secured to the legs 12 and 14. The rod is furthermore of a diameter slightly less than the width of the notches 22 in the lower edge of legs 18 and 19 so as to freely slide in those notches when inserted therein. It will be noted, particularly from FIG. 2, that the notches 22 are inclined at an angle which roughly corresponds generally with the angular disposition of legs 12 and 14 when the stand is in an elevated position. Thus, the rod 26 freely moves into the notches 22 when inserted therein. As will be explained in more detail, the vertical height of the stand is dependent upon which pair of notches 22 the rod 26 is inserted into.

The outer pair of legs 11 and 14 are pivotally secured to the longitudinal beams 18 and 19, respectively. Thus, the legs 11, 12, 13 and 14 adjustably support the platform 10 at a height determined by the pair of notches into which the rod 26 is inserted.

As will be described in more detail, the legs 11, 12, 13 and 14 and the beams of platform 10 are all made of relatively heavy material so as to adequately support heavy loads. In a typical case, the portion of the stand consisting of the platform 10 and the two pairs of legs weighs over 175 pounds. This is necessary if the platform is going to support heavy loads. The present platform is designed to support loads of as much as 4,000 pounds. It is obvious that with such a heavy construction, it would be very difficult for one man to adjust the height of this stand were it not for the means presently to be described.

Figure 4:
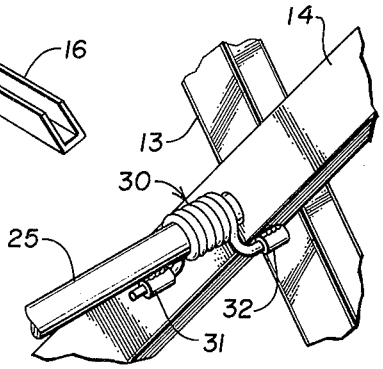
FIG. 4 is a fragmentary detail view of the biasing means of the adjustable stand, the view being on a somewhat larger scale than FIGS. 1, 2 and 3.

Referring specifically to FIG. 4, the numeral 30 indicates a coil spring which surrounds the rod 25 about which the legs 11, 12, 13 and 14 are pivotally supported. One end of coil spring 30 extends into a sleeve 31 welded to rod 25. The other end extends into a sleeve 32 welded to the underside of beam 14. It will be recalled that rod 25 is secured to the outer leg 13 as by welding. Hence, coil 30 tends to exert a force between legs 13 and 14. The spring is so formed, as viewed in FIG. 4, that the outer end of the spring tends to move in a counter clockwise direction with respect to the inner end. Thus, the effect of the spring 30 is to tend to move the upper ends of legs 13 and 14 together, raising the height of the platform 10 to which legs 13 and 14 are operatively connected. The effect of gravity, when the rod 25 is disengaged from the notches 22, is to tend to lower the stand. Thus, the spring 30 tends to compensate for the effect of gravity. It will be noticed from FIG. 3 that there is a second spring 33 on the side of rod 25 adjacent legs 11 and 12. This second spring is secured to rod 25, and hence to leg 11, and to leg 12 in the same manner as spring 30 and is designed to operate in the same way; that is, to tend to bias the upper ends of legs 11 an 12 together to raise the stand. The cooperative effect of springs 30 and 33 is such that the total force exerted thereby is slightly less than the gravitational force resulting from the weight of the platform 10 and the pairs of legs 11, 12, 13 and 14. The result is that the platform 10 can be easily raised or lowered, despite the weight of the platform and the weight of the two pairs of legs.

Figure 6:
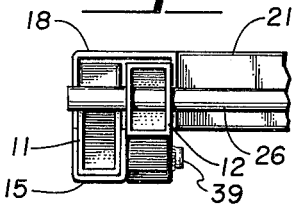
FIG. 6 is a fragmentary end elevational view of a portion of the stand, the view being taken along the plane indicated by lines 6—6 of FIG. 5 and in the direction of the arrows adjacent that line.

Referring now in more detail to the construction of the platform 10 and the beams 18, 19, 20 and 21, the two longitudinal beams 18 and 19 are, as shown in the drawing, channel shaped members with the side walls facing downwardly. The notches 22 are disposed in both side walls of each channel and are aligned. The longitudinal channel members 18 and 19 are of a width such that both legs 11 and 12 can be disposed therein. This is best shown in FIGS. 3 and 6. In other words, the internal width between the walls of channels 18 and 19 is slightly in excess of the combined width of legs 11 and 12 or legs 13 and 14.

The transverse beam members 20 and 21 are likewise channel shaped members. In the case of transverse member 20, the side walls are disposed horizontally. Furthermore, the upper side wall of the channel member 20 is substantially wider than the lower side wall, as best shown in FIG. 2. The reason for this is to provide an upper bearing surface of substantial area. The lower wall need not be as wide as the upper wall for structural reasons. Accordingly, in order to save material and weight, the lower side wall is somewhat narrower than the upper side wall, as just described.

Referring now to the other transverse beam member 21, the side wall of this beam are disposed vertically. The outer side wall is, as best shown in FIG. 2, somewhat shorter than the inner side wall. Again, this reduces the weight of the beam, while providing adequate structural strength. There is a further very important reason for this arrangement, however. The operator tends to grasp the beam 21 in raising or lowering the platform 10. If his hand is disposed on the right hand side of beam 21 (as viewed in FIG. 2) there is a danger of the rod 26 engaging the hand. Due to the weight of the various parts, this could cause a painful impact of the rod 26 against the operator's hand. By cutting away, however, the outer wall of the channel shaped member 21, the operator's hand does not extend outwardly as much as would otherwise be the case. Thus, clearance is provided for the hand and even when rod 26 is in the position in which it is in engagement with the innermost pairs of notches 22, the rod 26 will not engage the hand of the operator.

The legs 11, 12, 13 and 14 are preferably formed of tubular metallic stock of substantially rectangular cross section. The upper ends of legs 11 and 13 are disposed within the channels 18 and 19 and are pivotally secured thereto by pins 35 and 36, as best shown in FIGS. 1 and 2. These pin members 35 and 36 may be of a length just sufficient to extend through the respective channel members and the legs disposed therein and extend slightly beyond. The pin member may be retained in place on the inside by a cotter pin or any other suitable means.

Referring now to the details of the manner in which the leg members cooperate with the base members 15 and 16, it will be noted that each of the base members 15 and 16 is an inverted channel shaped member. The width between the side walls of the channel shaped members 15 and 16 is slightly greater than the individual width of the legs 11 and 13 so that the bottom of the legs will freely slide in the channel members. As will be evident from FIGS. 1 and 3, the other leg members 12 and 14 are disposed inside of leg members 11 and 13. The bottom ends of legs 12 and 14 are disposed inwardly of the inward walls of channel base members 15 and 16. Pivot pins 39 and 40 are employed to pivotally secure the legs 12 and 14 to the inner walls of channel members 15 and 16. This is best shown in FIGS. 1, 2 and 3. As shown, the pin members 39 and 40 are shown as extending entirely through the leg members 12 and 14 and through the inner walls of base members 15 and 16. It is to be understood, however, that the pins 39 and 40 may extend only through the outer walls of leg members 12 and 14 rather than completely through the leg members 12 and 14, as shown.

It will be noted that the lower ends of legs 11, 12, 13 and 14 are cut diagonally so as to extend at an acute angle with respect to the lower walls of the leg members rather than perpendicularly thereto as would be the case if the lower ends of the leg members were cut in the same manner as the upper ends of these leg members which results in further saving of material and reduction in weight and results in a somewhat more compact arrangement when folded.

Figure 5:
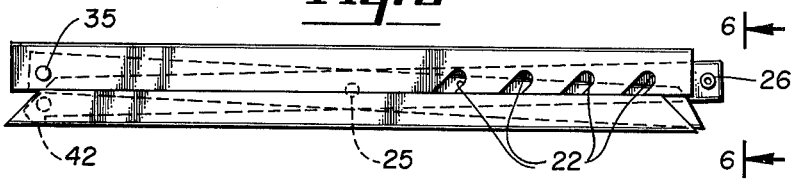
FIG. 5 is a front elevational view with the adjustable stand in collapsed position.

Referring again to the pivotal connection of legs 12 and 14 with base beam members 15 and 16, respectively, it will be noted in FIG. 2 that an arcuate structural member 42 is secured to the underside of the lower end of beam 14. This member is a quarter-round member and may be secured to the leg member 14 in any suitable manner as by welding. The purpose of the member 42 is to provide a lower curved bearing surface having a radius of curvature roughly corresponding to the distance between it and the pivot pin 40. The leg 14 is so connected to channel 15 that the lower end actually bears upon the floor. By providing this curved arcuate bearing surface 42, it is assured that the lower end of the leg 14 will always engage the floor while still permitting the base channel member 16 to rest upon the floor itself. A similar arrangement (not shown) is provided in connection with leg 12 so that the lower end of this leg likewise bears against the floor regardless of the angular position of legs 11 and 12. Referring to the use of the stand, the stand can be collapsed and assume the position shown in FIGS. 5 and 6. In this position, the stand is very compact and can be readily stored. Both legs 11 an 14 closely fit within the longitudinal beam member 18 and both legs 13 and 14 fit within longitudinal beam member 19, (as is evident from FIGS. 3 and 6) and since the leg members 12 and 14 fit on the inside of base members 15 and 16 and leg members 11 and 13 fit within the base members 15 and 16, it will be obvious that the unit can be folded so that it is quite compact.

When the operator desires to use this stand, all that it is necessary to do is to grasp the transverse beam member 21, lifting the platform 10 upwardly. Due to the counterbalancing effect of springs 33, described previously, this can be done readily despite the rather heavy weight of the platform and legs. The raising of the beam member 21 and the platform tends to also raise the legs 11, 12, 13 and 14 since legs 11 and 13 are pivotally connected to the platform and legs 12 and 14 are pivotally connected to legs 11 and 13. When the stand has been raised to the desired height, the tubular rod 26 is guided into the appropriate pair of notches 22 on the undersides of beams 18 and 19. The platform is then released and the platform will be securely locked in the desired position. Due to the angle of inclination of the notches 22, it is possible for the rod 26 to be accidentally moved out of notches 22. In fact, the heavier the load on the platform 10, the more firmly will the rod 26 be held in the notches 22. Since the legs 11 and 13 are of the same length as legs 12 and 14, the platform will remain level, regardless of the height of the adjustment.

One of the primary functions of the base channel members 15 an 16 is to provide lateral stability for the stand when the platform 10 is in its most elevated position. It will be obvious that as the height of the platform 10 is raised, the longitudinal spacing between the lower ends of the pairs of legs becomes less and less. In the most elevated position, the longitudinal spacing between legs 11 and 12, for example, becomes relatively small as shown in the perspective view of FIG. 1. If channel members 15 and 16 were not provided, there would be a tendency for the stand to readily tip over if the load became unbalanced on the platform 10, particularly that portion of the load on the overhanging portions of beams 18 and 19 including notches 22. By providing the base members 15 and 16 and having the lower ends of leg members 11 and 13 in sliding engagement therewith, the longitudinal length of the base is effectively extended so as to be that of the channel members 15 and 16, regardless of the position to which the platform is elevated. This insures a relatively stable platform, regardless of the height of adjustment of it. The stability is also aided by the fact that the legs are pivotally connected together near their midpoints so that the longitudinal spacing of the bottoms of the legs always remains the same as that of the tops of the legs.

While I have shown a specific embodiment of my invention, it is to be understood that this solely for purposes of illustration and that my invention is to be limited solely by the scope of the appended claims.

I claim:

1. An adjustable stand for supporting heavy loads at various heights, said stand comprising:

a platform comprising four channel shaped beam members rigidly fastened together in a generally rectangular configuration and having upper surfaces all disposed in a common plane to provide a flat supporting surface, two of said beam members being relatively long and extending longitudinally of said platform, the spaced side walls of said longitudinally extending channel shaped beam members extending downwardly and each having longitudinally spaced notches extending inwardly from the lower edges thereof, two pairs of legs disposed adjacent opposite sides of said platform and formed of beams of generally rectangular cross-section, the legs of each pair being pivotally secured together adjacent the longitudinal midpoints thereof, the upper end of a first leg of each pair extending between the downwardly extending side walls of the adjacent longitudinally extending beam member of said platform and being pivotally secured thereto, the upper ends of the other legs of said pairs being joined by a rod member of a cross-sectional configuration such as to fit within pairs of said spaced notches, the height of said platform being dependent upon the location of the pair of notches in which said rod member is placed, a pair of longitudinally extending base members of substantially the same length as the longitudinally extending beam members of said platform, said base members being formed of channel shaped members with upturned walls extending upwardly from the supporting surface, said upturned walls being spaced apart a distance at least as great as the width of the first legs of each pair of legs, the bottoms of such first legs being disposed between said upturned walls in slidable engagement with the bottom wall of the channel and the lower ends of the other legs of said pairs being pivotally secured to the side walls of said channels and of a length to engage a supporting surface, and resilient means biasing said legs towards a position in which said platform is at its maximum height to tend to counterbalance the weight of said platform and said legs and hence facilitating the vertical adjustment of said stand.

2. The adjustable stand of claim 1 in which the four beam members of said platform includes two transverse beam members, a first of which is fastened to said longitudinally extending beam members adjacent the end of said platform opposite said notches and the second of which is fastened to said longitudinal beam members at intermediate points thereof such that the portions of said longitudinal beams in which said spaced notches are located project beyond said second transverse beam member, said platform being free of transverse beam members along the portions extending beyond said second transverse beam member to enable ready access to said second transverse beam member for positioning said platform.

3. The adjustable stand of claim 1 in which the first of said transverse beam members is a channel member with the side walls disposed horizontally and in which the upper side wall is of greater width than the bottom side wall to increase the area of said flat supporting surface.

4. The adjustable stand of claim 1 in which the second of said transverse beam members is a channel member with the side walls facing downwardly and in which the outer side wall closest to said rod member is narrower than the inner side wall.

5. The adjustable stand of claim 1 in which there is a rod extending between pairs of legs at the points at which said pairs of legs are pivotally secured together, one leg of each pair being rigidly secured to said rod and the other leg of each pair being pivotally secured thereto, and in which the resilient means biasing said legs comprises a spring surrounding said rod and having one end secured to said rod and the other end secured to one of said legs pivotally secured to said rod.

6. The adjustable stand of claim 1 in which the spacing between the downwardly extending side walls of each of said longitudinally extending beam members of said platform is substantially equal to the combined width of the first and second legs of each pair of legs so that the upper ends of both legs are disposed between such side walls.

* * * * *